United States Patent [19]

Dinsmoor et al.

[11] Patent Number: 4,982,860

[45] Date of Patent: Jan. 8, 1991

[54] EXTRUSION FOR CONTAINER WITH INTEGRAL PALLET

[75] Inventors: John C. Dinsmoor, Denver; Barry Van Everen, Ft. Collins, both of Colo.

[73] Assignee: Stanley Aviation Corporation, Aurora, Colo.

[21] Appl. No.: 525,336

[22] Filed: May 14, 1990

Related U.S. Application Data

[62] Division of Ser. No. 340,795, Apr. 20, 1989, Pat. No. 4,936,476.

[51] Int. Cl.[5] ..... B65D 8/06; B65D 19/04

[52] U.S. Cl. ..... 220/606; 108/51.1; 108/901; 206/599; 220/1.5; 220/633; 220/612; 220/627

[58] Field of Search ..... 108/51.1, 901; 206/386, 206/599; 220/1.5, 72, 74, 76, 68, 69, 70, 425, 84, 85 K

[56] References Cited

U.S. PATENT DOCUMENTS

| | | | |
|---|---|---|---|
| 2,607,509 | 8/1952 | Hess | 220/68 X |
| 2,919,826 | 1/1960 | Richter . | |
| 3,044,656 | 7/1962 | Combs et al. | 220/1.5 X |
| 3,187,689 | 6/1965 | Hess | 108/51.1 |
| 3,529,743 | 9/1970 | Ehrbar et al. | 220/74 |
| 3,592,145 | 7/1971 | Petry | 108/51.1 |
| 4,013,021 | 3/1977 | Steinlein et al. | 108/901 X |
| 4,046,278 | 9/1977 | Chieger et al. . | |
| 4,138,163 | 2/1979 | Calvert et al. | 220/1.5 X |
| 4,169,407 | 10/1979 | Dorpmund | 220/1.5 X |
| 4,197,958 | 4/1980 | Zeri et al. | 220/72 |
| 4,286,507 | 9/1981 | Dorpmund | 220/1.5 X |
| 4,380,300 | 4/1983 | Mountz et al. . | |
| 4,428,306 | 1/1984 | Dreser et al. | 108/901 X |
| 4,493,428 | 1/1985 | Mittelmann et al. . | |
| 4,516,686 | 5/1985 | Chaussepied | 220/1.5 X |
| 4,673,087 | 6/1987 | Webb . | |
| 4,936,615 | 6/1990 | Moore | 220/1.5 X |

OTHER PUBLICATIONS

3 Drawings showing three extrusions for containers that include the integral pallet.

*Primary Examiner*—Bryon P. Gehman

*Attorney, Agent, or Firm*—Fields, Lewis, Pittenger & Rost

[57] ABSTRACT

An extrusion is provided which includes an upper double sidewall and a lower bulbous portion forming an integral pallet structure. This extrusion can be cut to suitable lengths and welded at the corners to form a sealed rectangular container bottom. A bottom panel is welded around its peripheral edge to the extrusion lengths. Reinforcing I-beams can be placed across the bottom and laterally spaced openings can be cut in the ends and sides of the bottom portions for receiving fork-lift tines. These cut-out portions can be reinforced by tubes or channel members, as required. This structure minimizes the critical welding required to make a sealed container bottom, since only the corner welds and the bottom panel welds are located where air leakage can occur.

3 Claims, 3 Drawing Sheets

EXTRUSION FOR CONTAINER WITH INTEGRAL PALLET

This is a division, of the application Ser. No. 340,795 filed Apr. 20, 1989.

TECHNICAL FIELD

This invention relates to a container and more particularly a container base formed integrally with a pallet as an extrusion.

BACKGROUND ART

When transporting sensitive products like electronic equipment, it is often necessary that it be housed in a controlled environment within a container. Many attempts have been made to provide suitable containers for this purpose. The type of containers required for military use or for air transport are usually made of aluminum or steel. Their construction usually requires extensive welding which is difficult to do for sustained lengths without any failures or undesirable distortions which compromise the sealing integrity of the container. In other words, the container may be air permeable along portions of the weld, which is unacceptable for the transportation of sensitive devices. Furthermore, the labor cost to do all of this welding is excessive.

Another difficulty is that many containers are formed separately from the pallets on which they rest and there must be means provided for securing the pallet to the container.

Among prior art devices developed are the following:

U.S. Pat. No. 4,673,087 to Webb discloses a collapsible container with extruded plastic panels having apertures for lift trucks at the bottom. The wall panels are of spaced double wall construction.

U.S. Pat. No. 4,493,428 to Mittelmann et al. has an air freight container with extruded hollow frame members and covered by sheet metal plates or the like. The container has pallet openings in its base.

U.S. Pat. No. 4,380,300 to Mountz et al. illustrates an air cargo container constructed of aluminum extrusions. Aluminum struts with corner blocks have stainless steel blocks in pockets for fork-lifts. This structure provides reinforced fork-lift openings so that worn parts can be replaced.

U.S. Pat. No. 4,046,278 to Chieger et al. discloses a cargo container formed of extruded light metal frames and panels. The container has pallet openings at the bottom.

U.S. Pat. No. 2,919,826 to Richter discloses a knockdown container with extruded aluminum framing and corrugated sheet coverings. Cleats on the bottom corners provide access for fork-lifts.

DISCLOSURE OF THE INVENTION

In accordance with this invention, an integral pallet has been provided which is formed from a single extrusion, made of a material such as aluminum, which can be cut to length and welded at the corners, thereby eliminating extensive welding requirements along edges or surfaces where leakage is unacceptable.

More particularly, a container constructed in accordance with this invention can be formed from an extrusion which comprises a sidewall having an inner panel and an outer panel spaced from the inner panel with an air space therebetween. A bumper panel is provided above the sidewall having an inner surface lying in the same plane as the inner panel and the sidewall and having an outer surface spaced outwardly of but parallel to the outer panel of the sidewall to form a first bumper edge. A pallet structure is formed below the sidewall and has an inner surface having an inner first portion extending downwardly and inwardly from the inner panel of the sidewall. An inner second portion extends downwardly from the depending edge of the inner first portion parallel to but inwardly of the inner panel. An outer first panel portion extends downwardly and outwardly from the outer panel of the sidewall. An outer second portion extends downwardly from the depending edge of the outer first portion and lies in the same plane as the outer surface of the bumper panel to form a second bumper edge. An outer third portion extends downwardly and inwardly from the depending edge of the outer second portion. A bottom, generally horizontal portion interconnects the bottom edge of the outer third portion in the bottom edge of the inner second portion to form a support base for the pallet structure. A lip extends inwardly from the inner second portion just below the inner first portion for supporting and welding a bottom plate thereto. The weld line around the periphery of the bottom plate is the only welding on the structure where a leak could occur. This complete welding integrity is required along this peripheral weld. Spaced transverse openings can be provided in the pallet structure for receiving tines of a fork-lift truck.

This extruded member can be cut into two longer side sections and two opposed end wall sections which are welded at the corners to form a rectangular container base. A first pair of laterally spaced openings can be provided which extend through the outer and inner walls of the end sections for receiving the tines of a fork-lift. A second pair of laterally spaced openings extends through the outer and inner walls of the side section centrally located from opposite ends thereof. A pair of transverse I-beams are located between this last pair of spaced openings and the end walls and each has a pair of spaced apertures for receiving the ends of fork-lift tines when they extend through the first pair of laterally spaced openings Transverse channels which also can be in the form of rectangular tubes, extend between the second pair of openings on opposite sidewalls and have an open side facing the I-beams for receiving the ends of the forklift tines when they extend through the first pair of openings and through the I-beam apertures. Tubular members face the periphery of each of the first pair of spaced openings to reinforce them.

With this construction, the advantages of this invention are readily apparent The container can be formed by cutting the extrusion to length and welding the adjoining ends to form a rectangular container with integral pallet. These welds must not permit any air leakage. The only other critical welding from an air leakage standpoint is the welding around the perimeter of the bottom panel which attaches it to the extrusions.

Additional advantages of this invention will become apparent from the description which follows, taken in conjunction with the accompanying drawings.

BEST MODE FOR CARRYING OUT THE INVENTION

Figure 1:
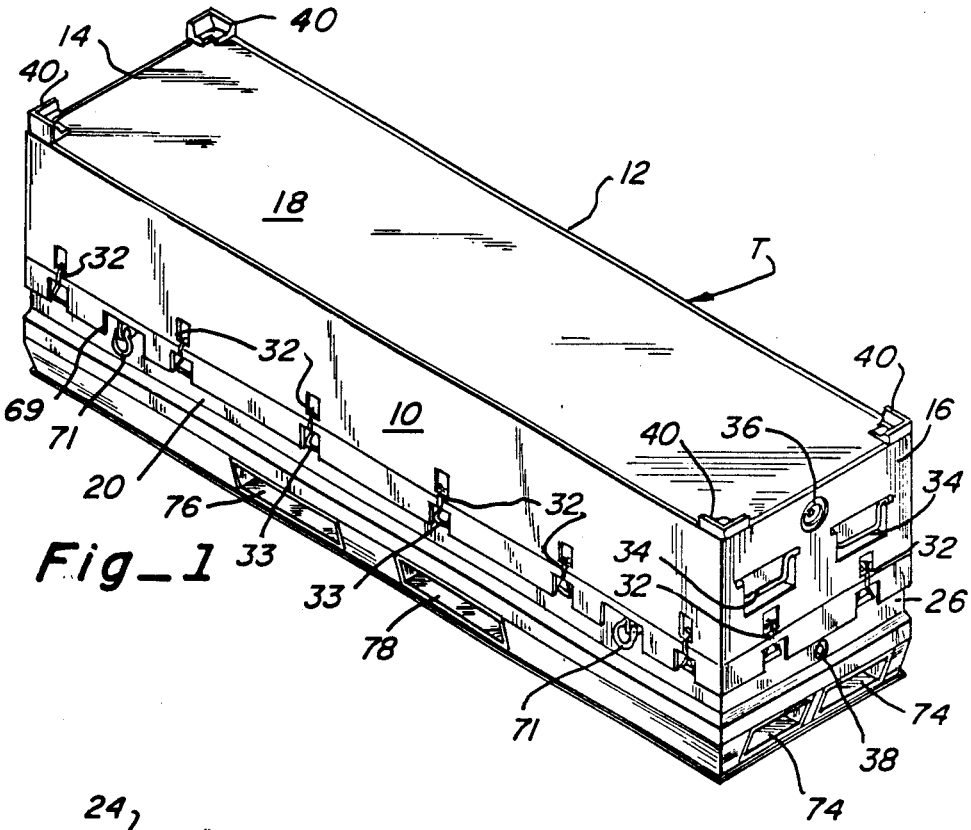
FIG. 1 is a perspective view of a container constructed in accordance with this invention.
Figure 2:
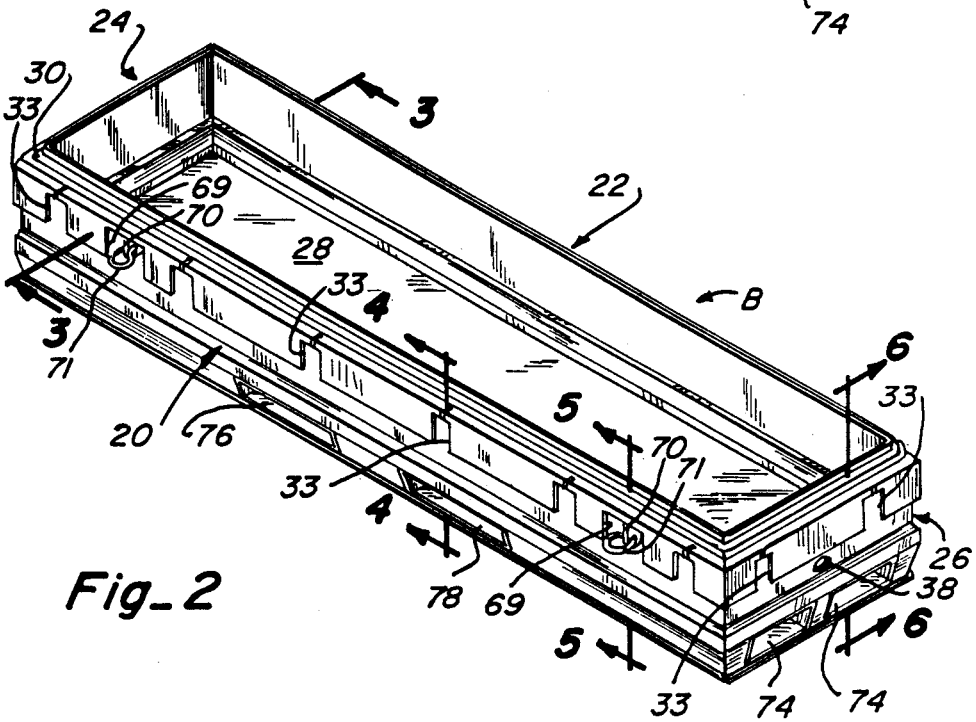
FIG. 2 is a perspective view showing the container of FIG. 1 without the lid.
Figure 3:
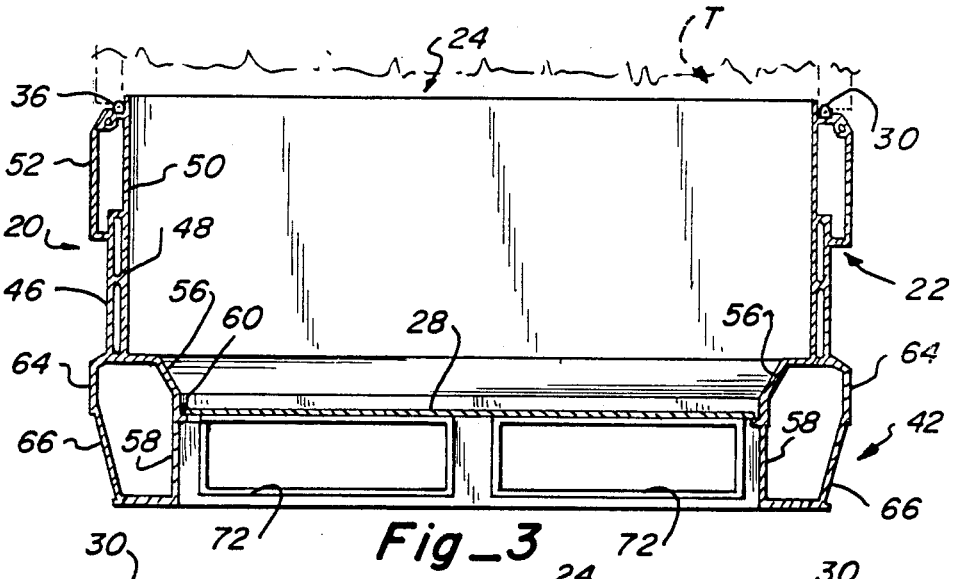
FIG. 3 is an enlarged, horizontal section, taken along line 3—3 of FIG. 2, showing further details of the construction.
Figure 4:
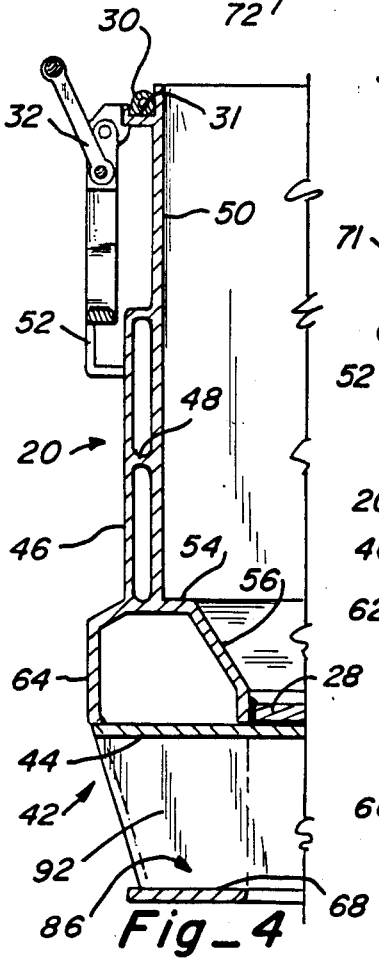
FIG. 4 is a greatly enlarged vertical section, taken along line 4—4 of FIG. 2, showing additional details of the extrusion of this invention.
Figure 5:
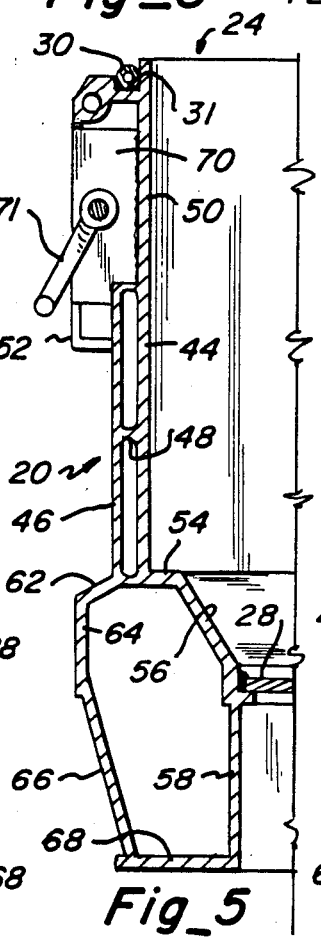
FIG. 5 is a greatly enlarged vertical section, taken along line 5—5 of FIG. 2, showing still further additional details of the sidewall.
Figure 6:
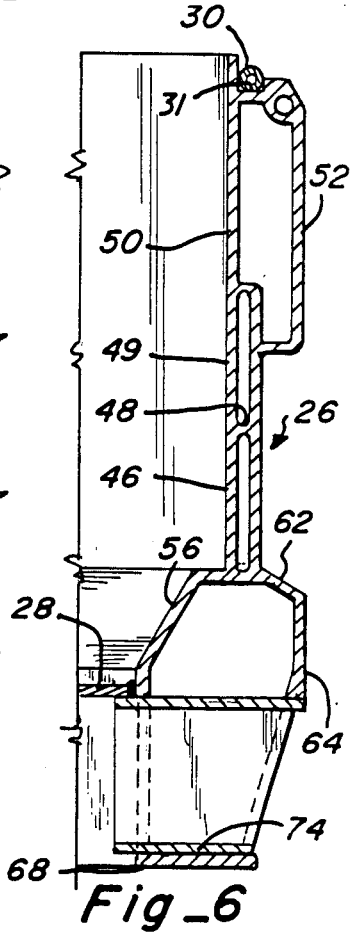
FIG. 6 is a greatly enlarged vertical section, taken along line 6—6 of FIG. 2, showing the end construction of the container.

In accordance with this invention, a sealed container is provided which has a top portion T and a bottom portion B as shown in FIG. 1 The term "sealed" as used herein means that there is no air leakage through the seams or joints of the container. The top portion includes opposed sidewalls 10 and 12 which are interconnected by end walls 14 and 16. A top wall 18 is provided, as shown. The bottom portion B includes opposed sidewalls 20 and 22 joined by end walls 24 and 26 and a bottom wall 28. A seal 30 is provided in a recess 31 around the upper peripheral edge of bottom B against which the lower edge of top portion T engages for sealing when the parts are secured together by latches 32 set in recesses 33 cut in the respective walls, as shown. When the top section T is attached by latches 32 to bottom section B the entire container can be picked up, as by handles 34 in end walls 14 and 16. A pressure relief valve 36 is provided in end wall 16 for equalizing the pressure within the container with pressurizing the atmospheric pressure. The pressure relief valve can be provided with a desiccant (not shown) to filter the air as it passes through the valve. A humidity sensor 38 is provided in end wall 26, as shown. Centering brackets 40 are provided at the upper corners of top portion T so that similar containers can be stacked on top of each other for transport, as in the cargo area of an airplane.

A unique feature of this invention is the fact that the bottom portion B of the container not only includes the sidewalls previously described, but these sidewalls are formed integrally with a pallet structure 42 which supports the container and bottom wall 28. In this regard, the bottom portions B can be formed as single extrusions which are cut and welded at the corners to form the rectangular configuration of the container. As best seen in FIGS. 3, 4, 5 and 6, sidewalls 20 and 22 and end walls 24 and 26 each include an inner panel 44 and an outer panel 46 at the lower portion thereof spaced outwardly from panel 44 and formed integrally therewith, as shown. A center rib 48 is provided for added strength. A bumper panel is formed above the sidewall 44 and has an inner surface or wall 50 lying in the same plane as inner panel 44 and formed integrally therewith. It is also provided with an outer surface or wall 52 which is outwardly of but parallel to outer wall 46 and forms a bumper edge or surface for contacting the bumper of similar contiguous containers.

A pallet structure is formed integrally below sidewall 20 and has an inwardly extending flange 54 which terminates at a downwardly and inwardly extending portion 56. An inner second portion 58 extends downwardly from the depending edge of the first portion 56. This portion 58 is generally parallel to but inwardly of inner panel 44 and extends to the bottom thereof. Intermediate the ends of portion 58 is an inwardly extending lip 60 for supporting bottom wall 28. A pallet portion 42 also includes an outer first portion 62 extending downwardly and outwardly from outer panel 46. An outer second portion 64 extends downwardly from the depending edge of outer first portion 6 and lies in the same plane as outer wall 52 of the bumper panel to form a second bumper edge. These bumpers protect the recessed hardware. An outer third portion 66 extends downwardly and inwardly from the depending edge of outer second portion 64. A bottom, generally horizontal portion 68 interconnects the bottom edge of outer third portion 66 and the bottom edge of the inner second portion 58 to form a support base for the pallet structure 42.

Figure 7:
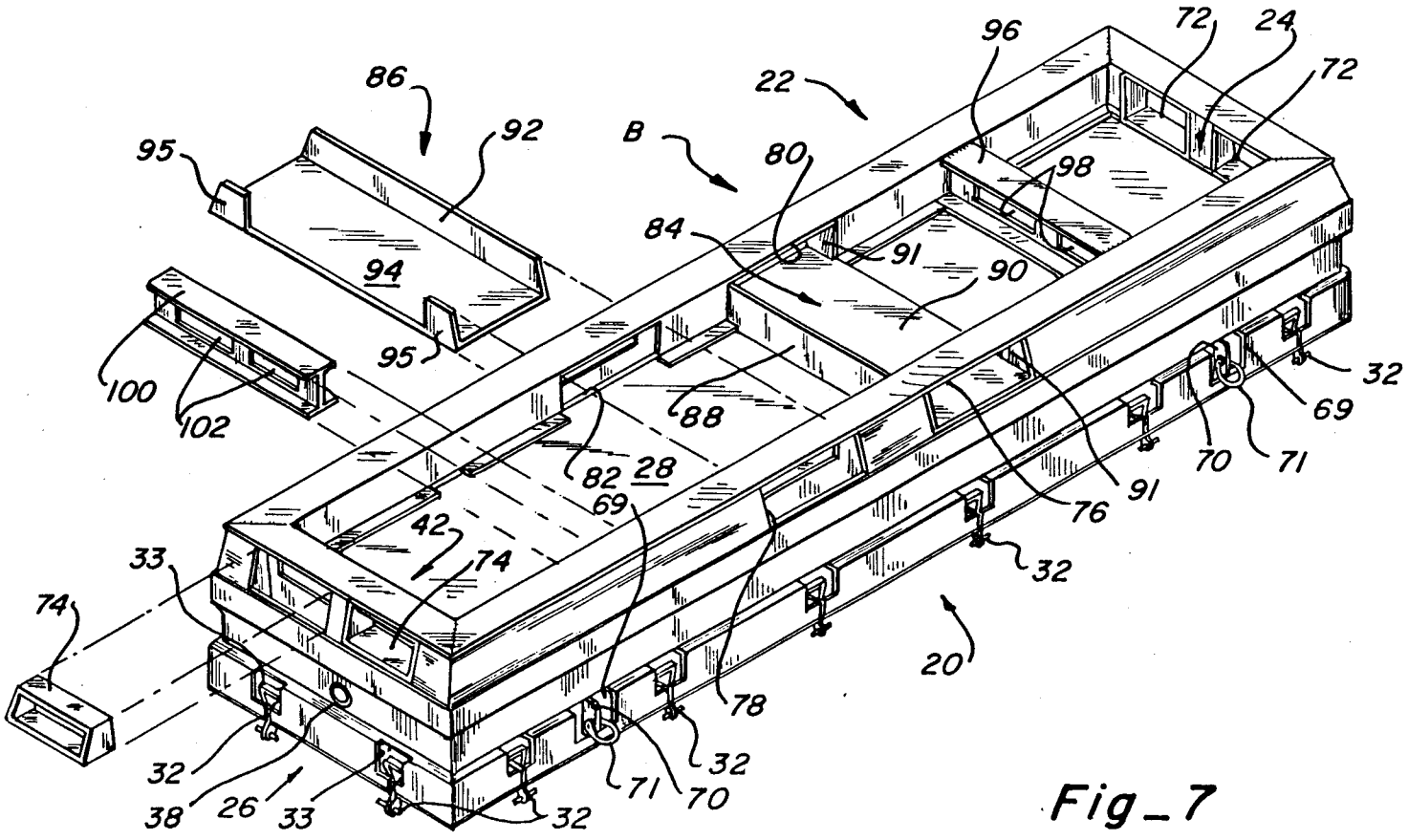
FIG. 7 is an enlarged bottom perspective view of the container, with exploded portions to show further details of construction.

As can best be seen in FIG. 7, end wall 24 has a pair of lateral slots cut through the lower portion of pallet 42 which are reinforced by tubes 72 welded thereto. This provides opening through which the tines of a fork-lift truck may be inserted. Similarly, end walls 26 have a pair of laterally spaced slots which have tubes 74 welded therein for also receiving tines of a fork-lift truck at the opposite end of the container. Intermediate the ends of sidewalls 20 and 22 are lateral slots 76, 78 and 80, 82, respectively. Slots 76 and 80 are interconnected by a laterally extending channel 84 and slots 78 and 82 are interconnected by a laterally extending channel 86. Conveniently, channel 84 has a sidewall 88 and a bottom wall 90. The other side is open on the side facing the end wall so that the ends of the tines of a fork-truck can extend into channel 84. Conveniently, this open side can be formed by milling, leaving upstanding ears 91 which close the space between wall portions 58 and 86 of pallet section 42. Similarly, channel 86 has an inner sidewall 92, bottom wall 94 and ears 95. Thus, channel 86 is open on the side that faces end wall 26 for reception of fork-lift tines inserted from that end.

Intermediate channel 84 and end wall 24 is an I-beam 96 that extends between opposite pallet portions 42 which has a pair of laterally spaced slots 98 in its web for receiving a fork-lift tines. Similarly, an I-beam 100 is provided intermediate channel 86 and end wall 26 which extends between opposite pallet portions 42 and has laterally spaced slots 102 in its web for receiving the fork-lift tines.

From the foregoing, the advantages of the present invention are readily apparent. The entire container base can be made from a single extrusion having a double sidewall and a bulbous bottom portion serving as a integral pallet wherein the amount of welding required is minimized. The only critical welding with regard to air leakage that is required is at each corner and to join the bottom panel to the extruded side walls and integral pallet, previously described. Thus, a sealable container base can be simply manufactured thereby reducing labor costs and increasing the quality of the finished product.

This invention has been described in detail with reference to a particular embodiment thereof, but it will be understood that various other modifications can be effected within the spirit and scope of this invention.

We claim:

1. An extrusion for forming an integral pallet and container, said extrusion comprising:

a sidewall having an inner panel and an outer panel spaced from said inner panel with an air space therebetween;

a bumper panel above said sidewall having an inner surface lying in the same plane as said inner panel of said sidewall and having an outer surface spaced outwardly of but parallel to said outer panel of said sidewall to form a first bumper edge; and a pallet structure formed below but integral with said sidewall and having an inner surface having an inner first portion extending downwardly and inwardly from said inner panel of said sidewall to a depending edge, an inner second portion extending downwardly from the depending edge of said inner first portion parallel to but inwardly of said inner panel and terminating in a bottom edge, an outer first portion extending downwardly and outwardly from said outer panel of said sidewall to a depending edge, an outer second portion extending downwardly the depending edge of said outer first portion and lying in the same plane as said outer surface of said bumper panel to form a second bumper edge and terminating in a depending edge, an outer third portion extending downwardly and inwardly from the depending edge of said outer second portion and terminating in a bottom edge, and a bottom, generally horizontal portion interconnecting the bottom edge of said outer third portion and the bottom edge of said inner second portion to form a support base for said pallet structure.

2. An extrusion, as claimed in claim 1, further including:

a lip extending inwardly from said inner second portion just below said inner first portion for supporting and attaching a bottom plate.

3. An extrusion, as claimed in claim 1, further including:

spaced transverse openings in said pallet structure for receiving tines of a fork-lift truck.

* * * * *